US005177429A

United States Patent [19]

Eki

[11] Patent Number: 5,177,429

[45] Date of Patent: Jan. 5, 1993

[54] DC POWER SOURCE CIRCUIT

[75] Inventor: Yutaka Eki, Saitama, Japan

[73] Assignee: Toko Kabushiki Kaisha, Tokyo, Japan

[21] Appl. No.: 699,492

[22] Filed: May 14, 1991

[30] Foreign Application Priority Data

May 18, 1990 [JP] Japan ..... 2-129878

[51] Int. Cl.[5] ..... G05F 1/571

[52] U.S. Cl. ..... 323/281; 323/349; 361/18; 361/111

[58] Field of Search ..... 323/281, 282, 349, 351; 361/18, 90, 91, 111

[56] References Cited

U.S. PATENT DOCUMENTS 4,633,162 12/1986 Melbert ..... 361/18 X

*Primary Examiner*—Emanuel T. Voeltz

*Attorney, Agent, or Firm*—Stevens, Davis, Miller & Mosher

[57] ABSTRACT

A series type d.c. power source circuit having a comparator for comparing a voltage detected by a current detector with a reference voltage and generating an overcurrent detection signal; and a controller connected in series with a power source line for controlling a d.c. output and executing an overcurrent protection operation, wherein one of a d.c. output division voltage and an output voltage and an oscillator circuit is mainly used as the reference voltage of the comparator, and the output voltage of the oscillator circuit is used during the overcurrent protection operation.

5 Claims, 3 Drawing Sheets

DC POWER SOURCE CIRCUIT

BACKGROUND OF THE INVENTION

The present invention relates to an overcurrent protection circuit for a d.c. power source circuit whose output is controlled in a serial manner.

DESCRIPTION OF RELATED BACKGROUND ART

There is widely used in the art a serial-type d.c. power source circuit which drops a voltage across power source lines to obtain a controlled output voltage, by using a control transistor connected in series with the power source line.

FIG. 6 is a schematic diagram showing a conventional d.c. power source circuit of this type. In a controller 1, a control transistor is connected in series with a hot side power source line 2 to control an output of the d.c. power source circuit. A voltage across an overcurrent detection resistor R1 connected in series with a cold side power source line 4 is compared with a reference voltage of a reference voltage source 5, by using a comparator 3. If the voltage across the resistor R1 exceeds the reference voltage during the overcurrent state, a signal outputted from the comparator 3 is applied to the controller 1. The controller 1 executes an overcurrent protection operation to suppress or fully stop an output of the d.c. power source circuit.

While an output is suppressed, current flows through the controller 1 with a certain voltage being applied across the controller 1. Therefore, thermal loss increases with time, requiring a large heat radiator for the protection of the controller 1. This causes a demerit in the case where the size of the power source circuit is made compact.

Furthermore, if an output voltage is maintained zero, the power source circuit cannot automatically recover a normal state, and it is necessary to turn off the power once and then turn on it, resulting in a cumbersome cancellation work of the protection operation.

SUMMARY OF THE INVENTION

The present invention aims at making small the thermal loss of a controller during the overcurrent state, and making compact the power source circuit by using a small radiator.

The present invention also aims at making small the effective value of current flowing through a load circuit and preventing burning of the circuit.

The present invention further aims at allowing an automatic recovery of the normal operation of obtaining a d.c. power from an overcurrent protection operation.

According to one aspect of the present invention, there is provided a series type d.c. power source circuit having a comparator for comparing a voltage detected by a current detector with a reference voltage and generating an overcurrent detection signal; and a controller connected in series with a power source line for controlling a d.c. output and executing an overcurrent protection operation, wherein one of a d.c. output division voltage and an output voltage of an oscillator circuit is mainly used as the reference voltage of the comparator, and the output voltage of the oscillator circuit is used during the overcurrent protection operation.

DETAILED DESCRIPTION OF THE EMBODIMENT

Figure 1:
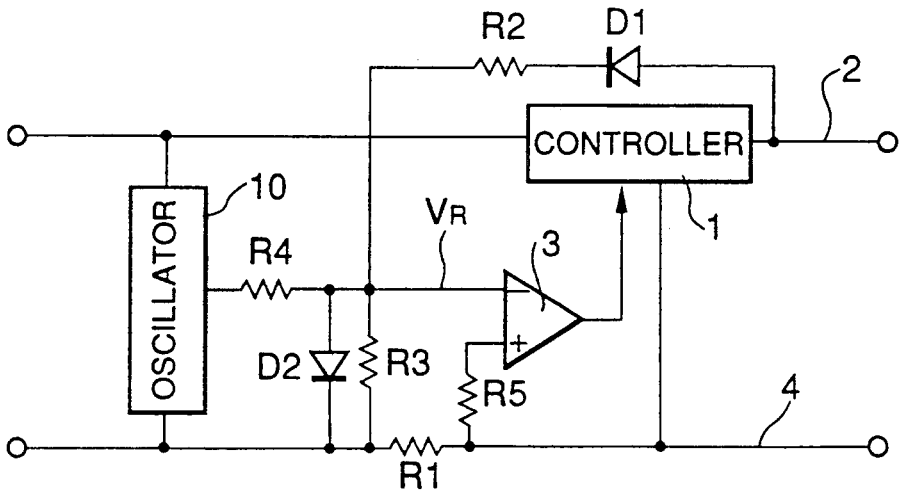
FIG. 1 is a schematic circuit diagram showing an embodiment of a d.c. power source circuit according to the present invention.
Figure 6:
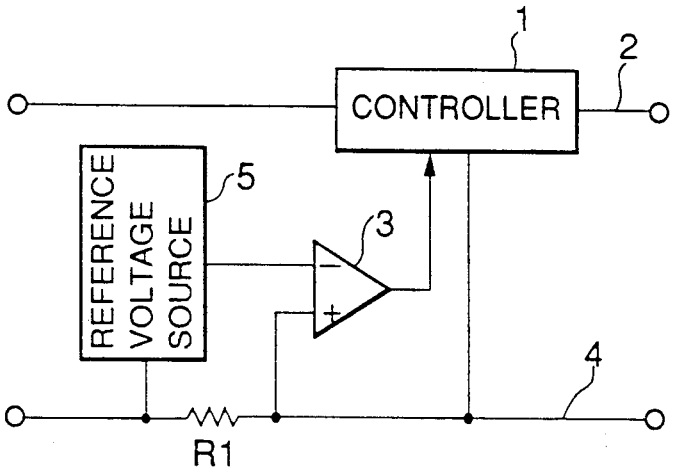
FIG. 6 PRIOR ART
FIG. 6 illustrates a conventional d.c. power source circuit.

An embodiment of a d.c. power source circuit of the present invention will be described with reference to FIG. 1. In FIG. 1, similar elements to those shown in FIG. 6 are represented by using identical reference numerals.

In a d.c. power source circuit shown in FIG. 1, a d.c. output voltage obtained at an output side of a controller 1 serially connected to the hot side of a power source line 2 is divided by resistors R2 and R3. This division voltage is superposed upon a rectangular output from an oscillator circuit 10. The resultant voltage is applied as a reference voltage to the inverting input terminal of an overcurrent detection comparator 3. This reference voltage is compared by the comparator 3 with a voltage across an overcurrent detection resistor R1 applied to the non-inverting input terminal of the comparator 3. Resistors R4 and R5 are bias resistors for the comparator 3.

Figure 3:
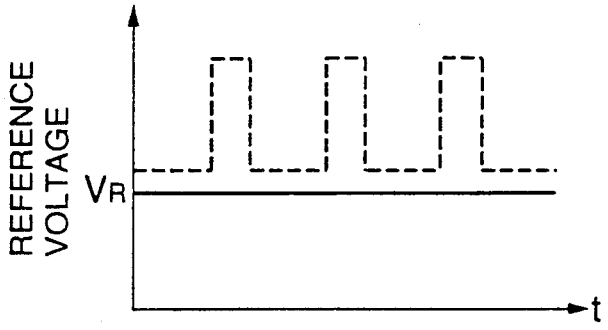
FIGS. 3 and 4 illustrate reference voltages.

In an equilibrium state while a d.c. output voltage is obtained, the output division voltage obtained through a diode D1 is superposed as a bias voltage upon an output of the oscillator circuit 10. However, in this case, the output of the oscillator circuit 10 is short-circuited by a diode D2 connected in parallel with the resistor R3 so that a certain voltage $V_R$ is applied as the reference voltage to the comparator 3. This voltage $V_R$ is shown in FIG. 3. Without the diode D2, the waveform of the reference voltage becomes as shown by a broken line in FIG. 3, having an output of the oscillator circuit 10 superposed upon a certain d.c. level.

If an overcurrent state occurs because of a short-circuit of a load or the like, when the voltage across the resistor R1 applied to the non-inverting input terminal of the comparator 3 becomes equal to the reference voltage $V_R$, the controller 1 controls to suppress or fully stop an output current flow, in accordance with an output signal of the comparator 3. That is, an overcurrent protection operation is carried out.

The reference voltage applied to the non-inverting input terminal of the comparator 3 therefore is a smaller d.c. output division voltage or a zero voltage.

Figure 4:
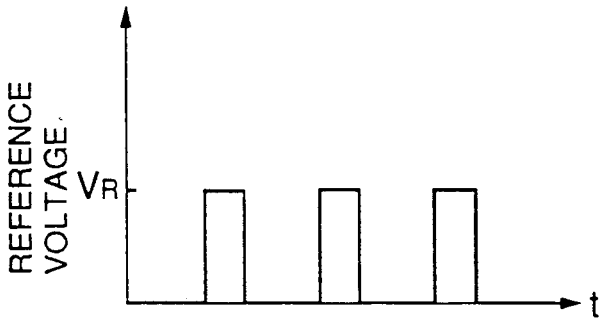

Accordingly, the rectangular output of the oscillator 10 is applied to the comparator 3 as the reference voltage, as shown in FIG. 4, assuming that the output division voltage is a zero voltage and only the output of the oscillator circuit 10 is used as the reference voltage. The abscissa shown in FIGS. 3 and 4 represents a time axis t.

Figure 5:
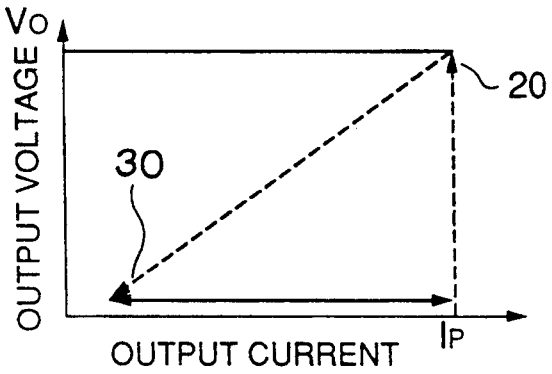
FIG. 5 is a graph showing the output characteristic of the d.c. power source circuit during an overcurrent protection operation.

FIG. 5 is a graph showing the output characteristic of the d.c. power source circuit when the overcurrent protection operation is carried out.

Vo represents a d.c. output voltage in an equilibrium state, and Ip represents a d.c. output current which may be detected as an overcurrent.

The rectangular voltage shown in FIG. 4 having its peak value same as the reference voltage $V_R$ in the equilibrium state is applied to the comparator as the reference voltage in the overcurrent protection operation. This reference voltage becomes zero at the bottom of the rectangular waveform, so that the effective value of the reference voltage lowers. As a result, the d.c. output voltage and current lower quickly as indicated by a broken line arrow 30. More in particular, since the rectangular waveform of the reference voltage changes periodically its value between a peak value and a zero value, the output current changes periodically at a small output voltage.

When a short-circuited load circuit recovers a normal state, the output voltage rises as indicated by a broken line arrow 20, so that the reference voltage recovers the state shown in FIG. 3, maintaining the equilibrium output control state.

The power loss P of the controller 1 during the overcurrent protection operation is given by:

$$P = V \times Ip \times T1/(T1 + T2) \quad (1)$$

where V represents a voltage across the controller 1, and T1 and T2 represent the times while the oscillator output takes a peak value and a zero value, respectively.

In contrast with a conventional method of suppressing an output, the thermal loss becomes small depending upon the duty ratio of the oscillator output, thereby allowing less heat generation and a smaller heat radiator. Burning of a load circuit obviously becomes rare. Recovery of an equilibrium state of a d.c. output is automatically performed.

Figure 2:
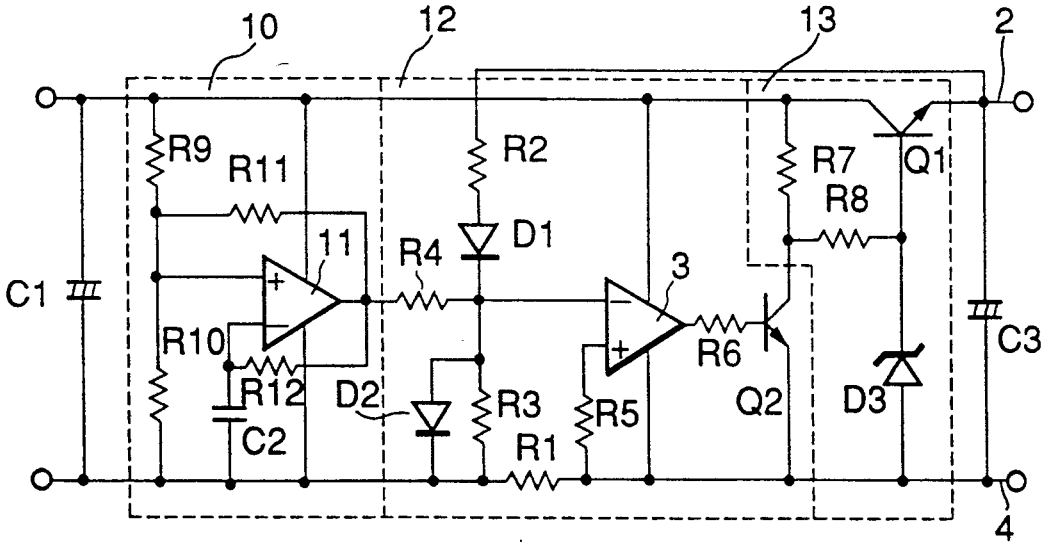
FIG. 2 is a circuit diagram showing a particular example of the d.c. power source circuit shown in FIG. 1.

FIG. 2 is a circuit diagram showing a particular example of the d.c. power source circuit shown in FIG. 1.

C1 represents a smoothing capacitor at the input side. The oscillator circuit 10 is constructed as a multivibrator. Specifically, a comparator 11 has its non-inverting input terminal connected to an interconnection between a resistor R9 and a resistor R10 serially connected between power source lines 2 and 4, and its inverting input terminal connected to one end of a capacitor C2 whose other end is connected to the power source line 4. A resistor R11 is connected between the non-inverting input terminal and output terminal of the comparator 11. A resistor R12 is connected between the inverting input terminal and output terminal of the comparator 11.

The overcurrent protection circuit 12 is constructed of the comparator 3 in FIG. 1, resistors R1 to R5, diodes D1 and D2, and a transistor Q2 connected via a resistor R6 to the output terminal of the comparator 3.

A control circuit 13 is constructed of a transistor Q1 serving as the controller 1, a constant voltage diode D3 for setting the base voltage of the transistor Q1, and resistors R7 and R8 for limiting the base current.

In the overcurrent state, the transistor Q2 of the overcurrent protection circuit 12 is intermittently turned on in response to a signal from the comparator 3 to remove the base current of the transistor Q1. Therefore, the transistor Q1 serving as the controller 1 intermittently turns on as described with FIG. 1 to derive an output current. C3 represents an output capacitor.

Various modifications of the d.c. power source circuit shown in FIG. 2 are possible. For example, the control circuit may be of the type that a control transistor connected in series to the power source line is chopped. The current detection unit may use a current detection transformer instead of a resistor. The controller may be constructed of a combination of a plurality of control transistors.

In the above embodiment, as the d.c. division output voltage, a zero voltage is used. This voltage may be set arbitrary to thereby control the reduction rate of a d.c. output during the overcurrent protection operation.

Furthermore, in the above embodiment, the output voltage of the oscillator circuit is applied as the reference voltage to the comparator during the overcurrent protection operation. This output voltage may be other types of voltages if they change periodically. For example, as such a voltage, a commercial power source voltage may be used after shaping it. The waveform may be a triangle or the like instead of the rectangle. Instead of the d.c. output division voltage, another reference voltage source may be provided.

As described so far, in the series-type d.c. power source circuit of the present invention, a periodically changing voltage superposed upon a d.c. voltage is used as the reference voltage of the comparator which detects an overcurrent. During the normal operation providing a predetermined output, the d.c. voltage is used as the reference voltage, whereas during the overcurrent protection operation, the periodically changing voltage is mainly used as the reference voltage. From the viewpoint of making compact the d.c. power source circuit, it is preferable to use an output voltage of an oscillator circuit as the periodically changing voltage and use a d.c. output division voltage as the d.c. voltage.

According to the present invention, heat generation of the controller becomes small and a heat radiator becomes compact, contributing to make compact the d.c. power source circuit. Burning of a load circuit obviously occurs hardly. Furthermore, recovery of the normal state can be automatically executed.

What is claimed is:

1. A d.c. power source circuit comprising:

a comparator for comparing a voltage detected by a current detector with a reference voltage and generating an overcurrent detection signal; and a controller connected in series with a power source line for controlling a d.c. output and executing an overcurrent protection operation, wherein a periodically changing voltage is used as said reference voltage during said overcurrent protection operation, wherein said periodically changing voltage is obtained from an oscillator circuit.

2. A series type d.c. power source circuit comprising:

a comparator for comparing a voltage detected by a current detector with a reference voltage and generating an overcurrent detection signal; and a controller connected in series with a power source line for controlling a d.c. output and executing an overcurrent protection operation, wherein one of a periodically changing voltage and a d.c. voltage is mainly used as said reference voltage of said comparator, and said periodically changing voltage is used during said overcurrent protection operation.

3. A d.c. power source circuit comprising:

a comparator for comparing a voltage detected by a current detector with a reference voltage and generating an overcurrent detection signal; and a controller connected in series with a power source line for controlling a d.c. output and executing an overcurrent protection operation, wherein one of a periodically changing voltage and a d.c. voltage is mainly used as said reference voltage of said comparator, and said periodically changing voltage is used during said overcurrent protection operation, wherein said periodically changing voltage is obtained from an oscillator circuit.

4. A series type d.c. power source circuit comprising:

a comparator for comparing a voltage detected by a current detector with a reference voltage and generating an overcurrent detection signal; and a controller connected in series with a power source line for controlling a d.c. output and executing an overcurrent protection operation, wherein one of a d.c. output division voltage and an output voltage of an oscillator circuit is mainly used as said reference voltage of said comparator, and said output voltage of said oscillator circuit is used during said overcurrent protection operation.

5. A d.c. power source circuit according to claim 4, wherein said reference voltage is said output voltage of said oscillator circuit superposed upon said d.c. output division voltage, said d.c. output division is used as a bias during the operation other than said overcurrent protection operation other than said of said oscillator circuit is used during said overcurrent protection mode because a reduction of said d.c. output division voltage.

* * * * *